US009062525B2

(12) United States Patent
Maclean et al.

(10) Patent No.: US 9,062,525 B2
(45) Date of Patent: Jun. 23, 2015

(54) OFFSHORE HEAVY OIL PRODUCTION

(75) Inventors: Donald Maclean, La Turbie (FR); Johannes Christiaan Lanfermeijer, Katy, TX (US); Michael Silverman, Houston, TX (US); Michael Hillerman, Willis, TX (US); Jimmy Pelham, Houston, TX (US)

(73) Assignee: SINGLE BUOY MOORINGS, INC., Marly (CH)

( * ) Notice: Subject to any disclaimer, the term of this patent is extended or adjusted under 35 U.S.C. 154(b) by 0 days.

(21) Appl. No.: 13/355,242

(22) Filed: Jan. 20, 2012

(65) Prior Publication Data

US 2013/0008663 A1 Jan. 10, 2013

Related U.S. Application Data

(63) Continuation-in-part of application No. 13/178,303, filed on Jul. 7, 2011.

(51) Int. Cl.

| | |
|---|---|
| ***E21B 43/36*** | (2006.01) |
| ***E21B 43/01*** | (2006.01) |
| ***E21B 33/03*** | (2006.01) |
| ***E21B 43/34*** | (2006.01) |
| ***E21B 7/128*** | (2006.01) |
| ***C10G 9/28*** | (2006.01) |
| ***C10G 9/36*** | (2006.01) |
| ***F01K 13/00*** | (2006.01) |
| *B63B 35/44* | (2006.01) |

(52) U.S. Cl.

CPC . *E21B 43/01* (2013.01); *C10G 9/28* (2013.01); *C10G 9/36* (2013.01); *F01K 13/00* (2013.01); *C10G 2300/4037* (2013.01); *C10G 2300/4068* (2013.01); *B63B 2035/4473* (2013.01); *B63B 2035/448* (2013.01)

(58) Field of Classification Search

CPC ..... E21B 43/534; E21B 43/36
USPC ..... 166/352, 357, 267, 369, 75.12; 210/747.1, 170.01, 539; 208/106
See application file for complete search history.

(56) References Cited

U.S. PATENT DOCUMENTS

| | | | | |
|---|---|---|---|---|
| 2,240,160 | A * | 4/1941 | Kaplan | 208/75 |
| 2,953,513 | A * | 9/1960 | Langer, Jr. | 208/56 |
| 3,228,467 | A * | 1/1966 | Schlinger et al. | 166/266 |
| 3,254,712 | A * | 6/1966 | Sharp | 166/266 |
| 3,310,109 | A * | 3/1967 | Belknap et al. | 166/256 |
| RE27,309 | E * | 3/1972 | Scott et al. | 95/253 |
| 3,945,435 | A * | 3/1976 | Barry | 166/267 |
| 4,007,786 | A * | 2/1977 | Schlinger | 166/266 |
| 4,026,357 | A * | 5/1977 | Redford | 166/261 |

(Continued)

FOREIGN PATENT DOCUMENTS

EP 44198 A2 * 1/1982

*Primary Examiner* — Matthew Buck
*Assistant Examiner* — Edwin Toledo-Duran
(74) *Attorney, Agent, or Firm* — Browdy and Neimark, PLLC

(57) ABSTRACT

A system is provided for the production of heavy crude oil from an undersea reservoir, and for the treatment of the crude oil to facilitate its transport. A floating body (12) which produces the heavy crude oil, carries a hydrocarbon cracking station (32) that cracks the heavy crude into light liquid and gaseous hydrocarbons, and that uses heat resulting from the cracking to produce pressured steam. The pressured steam is used to drive a steam-powered engine (72) (with pistons or a turbine) that drives an electrical generator (74) whose electricity powers the system.

5 Claims, 1 Drawing Sheet

(56) References Cited

U.S. PATENT DOCUMENTS

| | | | | | |
|---|---|---|---|---|---|
| 4,160,479 | A | * | 7/1979 | Richardson et al. | 166/267 |
| 4,223,728 | A | * | 9/1980 | Pegg | 166/266 |
| 4,248,306 | A | * | 2/1981 | Van Huisen et al. | 166/305.1 |
| 4,284,139 | A | * | 8/1981 | Sweany | 166/267 |
| 4,353,418 | A | * | 10/1982 | Hoekstra et al. | 166/259 |
| 4,683,945 | A | * | 8/1987 | Rozsa | 166/68.5 |
| 4,756,368 | A | * | 7/1988 | Ikuta et al. | 166/267 |
| 4,930,574 | A | * | 6/1990 | Jager et al. | 166/266 |
| 4,963,247 | A | * | 10/1990 | Belinko et al. | 208/112 |
| 5,097,903 | A | * | 3/1992 | Wilensky | 166/266 |
| 5,109,928 | A | * | 5/1992 | McCants | 166/266 |
| 5,254,781 | A | * | 10/1993 | Calamur et al. | 585/500 |
| 5,310,478 | A | * | 5/1994 | McCants | 208/100 |
| 5,477,924 | A | * | 12/1995 | Pollack | 166/357 |
| 5,792,340 | A | | 8/1998 | Freel et al. | |
| 5,929,125 | A | * | 7/1999 | Crane et al. | 518/702 |
| 6,505,467 | B1 | * | 1/2003 | Fjellhaug et al. | 60/780 |
| 7,270,743 | B2 | | 9/2007 | Freel et al. | |
| 7,572,365 | B2 | | 8/2009 | Freel et al. | |
| 7,584,789 | B2 | * | 9/2009 | Mo et al. | 166/267 |
| 7,591,310 | B2 | * | 9/2009 | Minderhoud et al. | 166/267 |
| 8,210,259 | B2 | * | 7/2012 | De Francesco | 166/261 |
| 2003/0124034 | A1 | * | 7/2003 | Wu et al. | 422/139 |
| 2006/0116543 | A1 | * | 6/2006 | Bellet et al. | 585/648 |
| 2006/0283590 | A1 | * | 12/2006 | Poldervaart et al. | 166/265 |
| 2006/0283802 | A1 | * | 12/2006 | Gordon | 210/652 |
| 2007/0021513 | A1 | * | 1/2007 | Agee et al. | 518/700 |
| 2011/0130474 | A1 | * | 6/2011 | Moon et al. | 518/702 |

* cited by examiner

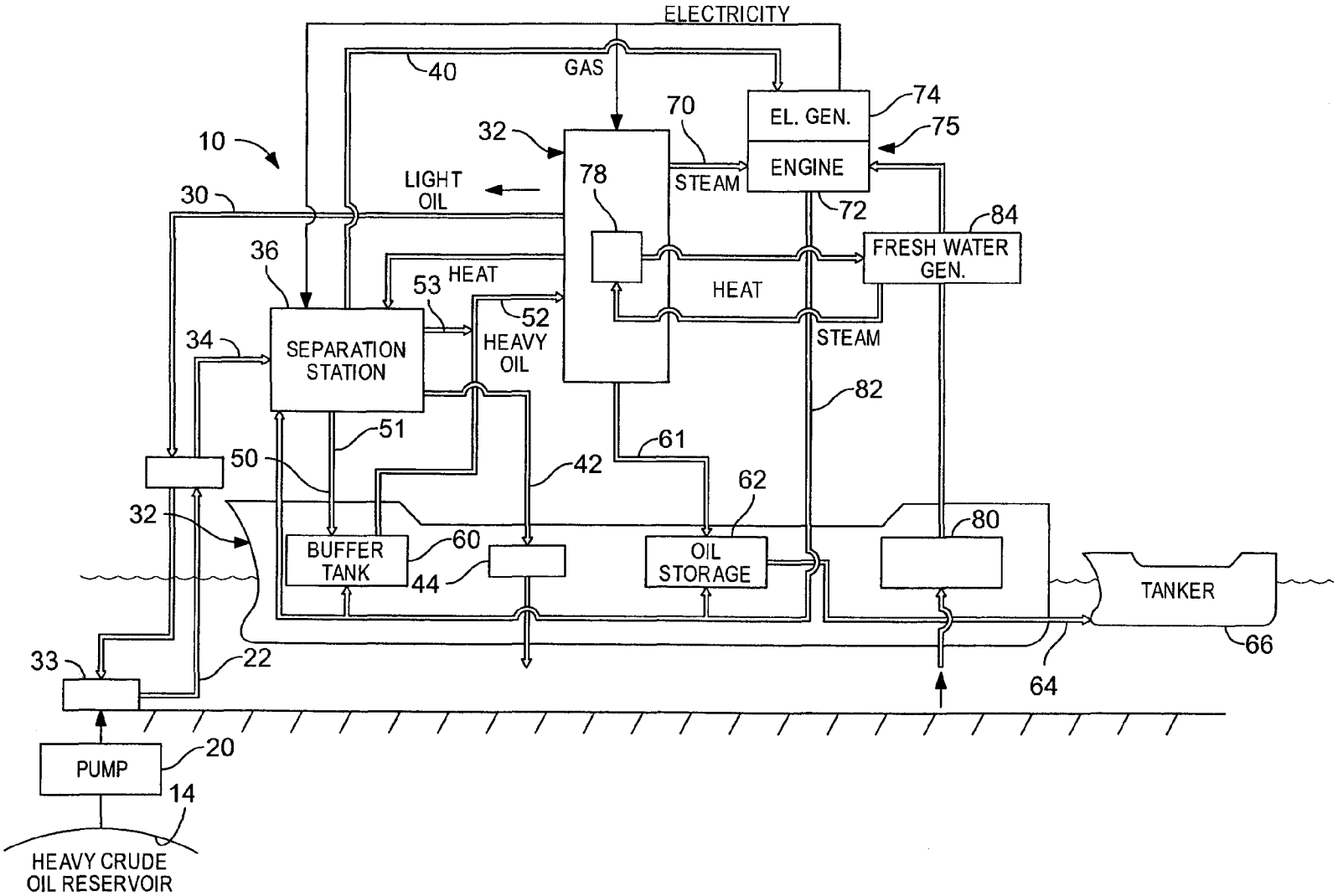
ELECTRICITY
EL. GEN.
ENGINE
74
75
72
84
FRESH WATER GEN.
STEAM
82
80
TANKER
66
64
70
STEAM
HEAT
62
OIL STORAGE
61
GAS
78
42
52
HEAVY OIL
32
LIGHT OIL
HEAT
53
60
44
40
SEPARATION STATION
51
BUFFER TANK
36
10
30
34
50
22
20
14
32
PUMP
33
HEAVY CRUDE OIL RESERVOIR

OFFSHORE HEAVY OIL PRODUCTION

CROSS-REFERENCE

This is a Continuation-In-Part of U.S. patent application Ser. No. 13/178,303 filed Jul. 7, 2011.

BACKGROUND OF THE INVENTION

Some undersea hydrocarbon reservoirs contain a high proportion of heavy crude oil (hydrocarbons), so output from the reservoir (over a period of a plurality of days) comprises over 50% hydrocarbons of a density above that of water and with a high viscosity. Such heavy crude oil generally contains at least 60 carbon atoms per molecule and/or has a viscosity on the order of magnitude of over 0.5 poise. Other liquid hydrocarbons (light oil or light liquid hydrocarbons) generally have about 5 to 10 carbon atom per molecule (light oil). Hydrocarbons with less than 4 or 5 carbon atoms per molecule are generally gas. Heavy oil hydrocarbons are difficult to treat and are difficult to pump into and out of storage tanks. The heavy crude can be cracked in refineries to produce light oil (generally oil having a specific gravity less than water and with a low viscosity) which is usually the most desirable hydrocarbons, but considerable effort is required to handle and transport the heavy crude to the refinery. A system that could be used at an offshore heavy crude oil production facility to crack heavy crude oil so as to facilitate its transport and transfer through pipes to a further refining and treatment facility, would be of value.

SUMMARY OF THE INVENTION

In accordance with the present invention, a floating hydrocarbon production facility is provided that is anchored to the sea floor to lie near an offshore heavy hydrocarbon reservoir, which treats the heavy hydrocarbons to facilitate their transport, transfer through pipes, and further treatment. The facility includes a separation station that separates the well effluent into light liquid oil, heavy crude oil, gaseous hydrocarbons, water, and solid materials (e.g sand). The heavy oil (oil with a specific gravity greater than water and generally with a API of less than 20) passes to a cracking station on the floating facility that cracks, or breaks down, the heavy crude oil into light crude oil. Such cracking can be accomplished in a number of ways. One approach is to use thermal cracking, such as "steam cracking" in which steam at about 800° C.° (650 to 1000° C.) is applied to the crude oil. Another approach is to spray preheated heavy oil at a hot fluidized catalyst to break down the oils into various light oils (referred to as a FCC process, or process that uses fluidized carbon cracking). The cracking methods require large amounts of hot pressured steam and produce more hot steam. The processes also require considerable amounts of electricity. Much of the pressured steam produced in the cracking process is used to drive a steam engine (piston or turbine) that, in turn, drives an electric generator. Water from the sea is used in operating the steam engine (to provide water that converts to steam, and to cool the steam after it passes through the steam engine), and in the cracking process.

There are many other known methods for cracking heavy oil.

The novel features of the invention are set forth with particularity in the appended claims. The invention will be best understood from the following description when read in conjunction with the accompanying drawings.

BRIEF DESCRIPTION OF THE DRAWINGS

FIG. 1 is a diagrammatic view of an offshore hydrocarbon production facility of the present invention, with a tanker shown in a reduced size.

DESCRIPTION OF THE PREFERRED EMBODIMENTS

FIG. 1 illustrates a production facility 10 of the invention, which includes a floating structure 12 which carries treatment equipment that produces and treats heavy crude oil, or heavy hydrocarbons, from an undersea reservoir or well 14. Heavy crude oil can be considered to be oil having an API (American Petroleum Institute) rating of less than 20, so the oil floats on water. Such oil generally has a high viscosity such as on the order of magnitude of at least 0.5 poise, and/or has hydrocarbons with at least 60 carbon atoms per molecule. Fluid from the seafloor reservoir passes through an electrically-energized pump 20 that lies within tubing extending down to the well or that lies in the downhole casing. The pump pumps the fluid through a riser 22 up to the vessel or other floating structure 12 at the sea surface. Part of the oil is light oil that passes through a conduit 30 from a cracking station 32, towards a "Christmas tree" 33 on the seabed, and helps in lifting heavy crude oil from the well. Heavy oil and gas from the reservoir pass through a conduit 34 to a separation station 36. The separation station 36 separates out gas, which optionally flows through conduit 40 to a gas turbine power generator set 75. The set 75 is an engine-generator set that uses steam (which may be produced by gas) to drive a generator 74 that generates electricity. Produced water flows through a pipe 42 to a settling tank 44. Other non-hydrocarbon material such as sand and stones, are released into the sea after treatment.

In FIG. 1, heavy crude oil entering the separation station 36 is delivered through outlets 51, 53 of conduits 50, 52 to the station 32, which is a cracking station that converts heavy crude oil to light crude oil. The cracking station uses hot (e.g. 800° C.) sand to break down heavy crude and uses a small amount of hydrocarbon gas and diluent to initially generate heat and steam. The process reuses the sand and creates additional heat which creates additional steam. Applicant uses the additional steam, as described below.

Applicant provides a heavy oil storage tank, or buffer 60 that receives heavy crude oil from the separation station 36 and that can deliver heavy crude oil to the cracking station 32. Optimum operation of the cracking station 32 requires a steady flow of heavy crude oil into the station. When the flow through the conduit 34 deceases, this shortfall is made up by the flow of oil from the buffer tank 60 to the cracking station. The buffer tank preferably has a capacity to store more oil than the average flow of oil into the cracking station in one minute (more than 1,000 gallons and preferably more than 5,000 gallons). Heavy crude that has been cracked at the cracking station into light oil, is delivered through conduit 61 to a light oil storage tank 62, and from the light oil storage tank the oil flows through a transfer system 64 to a tanker 66, or to an export pipeline on the sea bed (not shown). The tanker 66 carries the oil to a distant refining facility where appropriate amounts of oil of selected densities are combined. The fact that oil in the storage tank 62 is light oil, means that it can be readily loaded into the tanker 66, as by passing through a pipeline, and later unloaded and further processed. Such further processing can be used to obtain the desired mix of light oils and additives, etc.

The cracking station 32 uses hot sand and/or steam to heat incoming heavy crude oil at 52 to crack it, with the process creating additional heat which is carried away by additional steam. Applicant uses the steam to produce electricity. The steam produced by the cracking station is delivered through a conduit 70 to a steam powered engine 72, which can be a steam engine that has pistons or which can include a steam turbine. The vessel can have boilers (78) that use hydrocarbons to create steam during startup of the process. The steam powered generator is connected to an electrical generator 74 that generates electricity. Alternatively, a closed loop heat transfer system can be used to deliver the steam to apparatus that heats it and delivers the heated steam to the engine 72.

Steam is produced by the cracking station only after a period of operation (e.g. quarter hour). During this time, applicant uses hydrocarbon gas that flows through conduit 40 to drive an engine-generator set such as 75 wherein electricity is obtained from the generator 74. The gas can be ignited and used to energize the same engine 72 or an auxiliary one. In the present embodiment a steam generator is used, but as an alternative, steam from vessel steam boilers 78 can be used to start up the process.

Applicant passes excess steam at the engine 72 through a conduit 82 to the buffer tank 60 to heat heavy crude therein so it flows more easily. Excess heat also can be used to heat light oil in the light oil tank 62. It is well known that steam exiting a steam engine is usually cooled in order to decrease its pressure so there is a large pressure differential between incoming and outgoing steam. Applicant uses a seawater lift pump system 80 to deliver sea water to a fresh water generator 84 that uses heat to produce clean water (most salt removed). The clean water is passed to the steam engine to cool the exiting steam and to produce clean water for the steam engine. Electricity from the generator 74 is used to power pumps that pump fluids into various stations. These include the pump 20 that pumps heavy crude up through a riser, an offloading pump that pumps light oil to the tanker 66 that carries oil away from the floating structure 12, and a seawater lift pump 80 that provides water to the steam engine.

Thus, the invention provides a method and system for handling oil that is produced from an offshore reservoir or seabed pipeline that produces primarily (at least 50%) heavy crude oil. The crude oil is produced from the reservoir by a floating structure, or vessel, that includes a cracking station that cracks the crude oil after it has been initially processed to remove water, sand, gas and light oil. The cracking station preferably uses high temperature (e.g. 800° C.) steam to crack the heavy oil to produce light oil or lighter oil (less viscous oil) that can be more easily pumped or otherwise flowed through pipes for processing and transport. Steam created by cracking heavy oil into light oil, is used to energize a steam engine that powers an electrical generator, with sea water used as a coolant for the steam engine. Electricity from the electrical generator powers the cracking station and other facilities, and electricity can be exported to consumers on shore or to another offshore system through a cable.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for efficiently obtaining light oil from an undersea reservoir (14) which produces a produced fluid that contains heavy oil, comprising:

passing said produced fluid from the undersea reservoir up from said reservoir through a riser (22) to a floating structure (12) that floats at a sea surface;

passing said produced fluid to a separation station (36) on the floating structure, and, in said separation station separating the heavy crude oil of said produced fluid into hydrocarbons and non-hydrocarbon material, and separating the hydrocarbons into gaseous hydrocarbons, light oil, and heavy oil, including disposing of said non-hydrocarbon material into the sea;

flowing said heavy oil to a hydrocarbon cracking station (32) on said floating structure wherein said hydrocarbon cracking station is energizable in part by electricity, and energizing said hydrocarbon cracking station to crack said heavy oil to produce light oil, gaseous hydrocarbons, and heat;

using said heat produced by said hydrocarbon cracking station to energize a steam generator to produce pressured steam, using said pressured steam to drive a steam engine (72), using said steam engine to drive an electrical generator (74), and using a portion of electricity from said electrical generator to energize said cracking station.

2. The method described in claim 1 including:

storing a quantity of heavy oil in a heavy oil buffer tank (60) that is connected to said cracking station, and flowing heavy oil from said oil buffer tank to said hydrocarbon cracking station in an amount that results in a constant flow of heavy oil to said hydrocarbon cracking station (32), and using pressured steam from said steam generator to heat oil in said crude oil buffer tank, and cracking the oil in said cracking station before transporting it.

3. The method described in claim 1 wherein: said hydrocarbon cracking station has a heavy oil storage tank, and including using steam from said steam generator to heat heavy oil in said heavy oil storage tank before cracking the heavy oil and then transporting it.

4. An apparatus for producing hydrocarbons from an undersea reservoir which produces a produced fluid that contains heavy oil, comprising:

a floating structure (12) that floats at sea surface, and a riser (22) that connects said reservoir to said floating structure;

a separation station (36) on said floating structure which is coupled to said riser and which separates the heavy crude oil of said produced fluid into hydrocarbons and non-hydrocarbon material, and separates the hydrocarbons into gaseous hydrocarbons, light oil, and heavy oil, said separation station having a heavy oil outlet (51, 53) and said separation station uses electrical power;

a cracking station (32) on said floating structure which is connected to a heavy oil outlet (53) of said separation station, said cracking station having a light oil outlet (61) and a steam outlet (70) and which is arranged to crack said heavy oil to produce light oil, gaseous hydrocarbons, and heat;

an engine-generator set that receives heat from said cracking station to energize a steam generator to produce pressured steam to drive a steam engine and which uses the steam engine to drive an electrical generator (74), said electrical generator having an electrical outlet connected to said cracking station;

wherein the cracking station is energized by using a portion of electricity from said electrical generator.

5. The apparatus described in claim 4 including: a buffer tank (60) which stores heavy oil and which has an inlet connected to said separation station to receive and store heavy oil therefrom and an outlet connected to said cracking station.

* * * * *